US005282620A

United States Patent [19]

Keesee

[11] Patent Number: 5,282,620

[45] Date of Patent: Feb. 1, 1994

[54] LOTTERY GAME AND METHOD OF PLAYING A LOTTERY GAME

[76] Inventor: Roger N. Keesee, 401 E. Ontario, Unit 3509, Chicago, Ill. 60611

[21] Appl. No.: 867,774

[22] Filed: Apr. 13, 1992

Related U.S. Application Data

[63] Continuation-in-part of Ser. No. 795,129, Nov. 20, 1991.

[51] Int. Cl.[5] ..... A63F 3/06

[52] U.S. Cl. ..... 273/138 A

[58] Field of Search ..... 273/138 A, 138 R, 139, 273/148 R, 854, 292

[56] References Cited

U.S. PATENT DOCUMENTS

| | | | |
|---|---|---|---|
| 3,759,525 | 9/1973 | Davis | 273/143 R |
| 4,689,742 | 8/1987 | Troy et al. | 273/138 A |
| 4,837,728 | 6/1989 | Barrie et al. | 364/412 |
| 4,842,278 | 6/1989 | Markowicz | 273/138 A |
| 4,871,171 | 10/1989 | Rivero | 273/138 A |
| 5,042,818 | 8/1991 | Weingardt | 273/292 |
| 5,106,089 | 4/1992 | Wood | 273/139 |

FOREIGN PATENT DOCUMENTS

| | | | |
|---|---|---|---|
| 2147773 | 5/1985 | United Kingdom | 273/138 A |
| 2148135 | 5/1985 | United Kingdom | 273/138 A |

OTHER PUBLICATIONS

Virginia Lottery Pick 3 and Pick 4.

*Primary Examiner*—Benjamin H. Layno

*Attorney, Agent, or Firm*—Mason, Kolehmainen, Rathburn & Wyss

[57] ABSTRACT

A lottery game having a central processor and a plurality of remote terminals for playing a lottery game and a method of playing a lottery game are provided. Responsive to a received player's bet, a plurality of objects are randomly selected. Game results are calculated and the plurality of randomly selected objects are then printed on a lottery ticket responsive to the evaluated game results.

13 Claims, 3 Drawing Sheets

LOTTERY GAME AND METHOD OF PLAYING A LOTTERY GAME

BACKGROUND OF THE INVENTION

Related Application

This application is a continuation-in-part of copending U.S. patent application Ser. No. 07/795,129, filed Nov. 20, 1991.

1. FIELD OF THE INVENTION

The invention relates generally to the field of lottery games, and more particularly to a lottery game and a method of playing a lottery game.

2. DESCRIPTION OF THE PRIOR ART

Known lottery games generally include instant scratch-off ticket and on-line computerized games. An advantage of instant scratch-off ticket games is that a player knows instantly whether or not he has won a prize. Typically both instant scratch-off tickets and on-line computerized systems provide prize amounts that are paid on a pari-mutuel basis. As a result, significantly decreased sales of instant scratch-off tickets can result after it is known that large prizes have been paid.

Many of the on-line computerized system games provide limited excitement for the players due to the time required waiting for drawings that determine the winning tickets.

Video draw poker games often are skill-based games that do not require a lottery agent and can provide instant prize results. For example, a computer video draw poker game is disclosed in U.S. Pat. No. 4,743,022. However, a non-skill game or a game of pure chance is a more suitable lottery game so that the less intelligent player is not penalized.

U.S. Pat. No. 4,652,998 discloses a video gaming system including consumer operated terminals each having a video amusement game display and connected to a central controller which supervises the network of terminals. The consumer operated terminals can be customized for different types of games. The video gaming system includes a prize distribution arrangement with the central controller assigning a minipool to each terminal. The minipool represents a fixed number of game plays and a predetermined number of prizes. Examples of skill and non-skill games are disclosed.

It is desirable to provide a lottery game and lottery gaming method that increases player participation and lottery sales. It is further desirable to provide such a lottery game and method for use with a conventional type of lottery system that utilizes a central processor and lottery tickets printed at multiple remote terminals that are operated by either a lottery agent or a game player.

SUMMARY OF THE INVENTION

Important objects of the present invention are to provide a lottery game and lottery gaming method where a player competes against a fixed paytable and a pari-mutuel rather than other players; to provide a lottery game and lottery gaming method where skill of play is not a factor and to provide a lottery game and lottery gaming method that overcome disadvantages of prior art arrangements.

In brief, the objects and advantages of the present invention are achieved by a lottery game including a central processor and a plurality of remote terminals for playing the lottery game. Responsive to a received player's bet, a plurality of objects are randomly selected. Game results are calculated and the plurality of randomly selected objects are then printed on a lottery ticket responsive to the evaluated game results.

BRIEF DESCRIPTION OF THE DRAWING

The present invention together with the above and other objects and advantages may best be understood from the following detailed description of the embodiment of the invention illustrated in the drawings, wherein.

DETAILED DESCRIPTION OF THE PREFERRED EMBODIMENT

Figure 1:
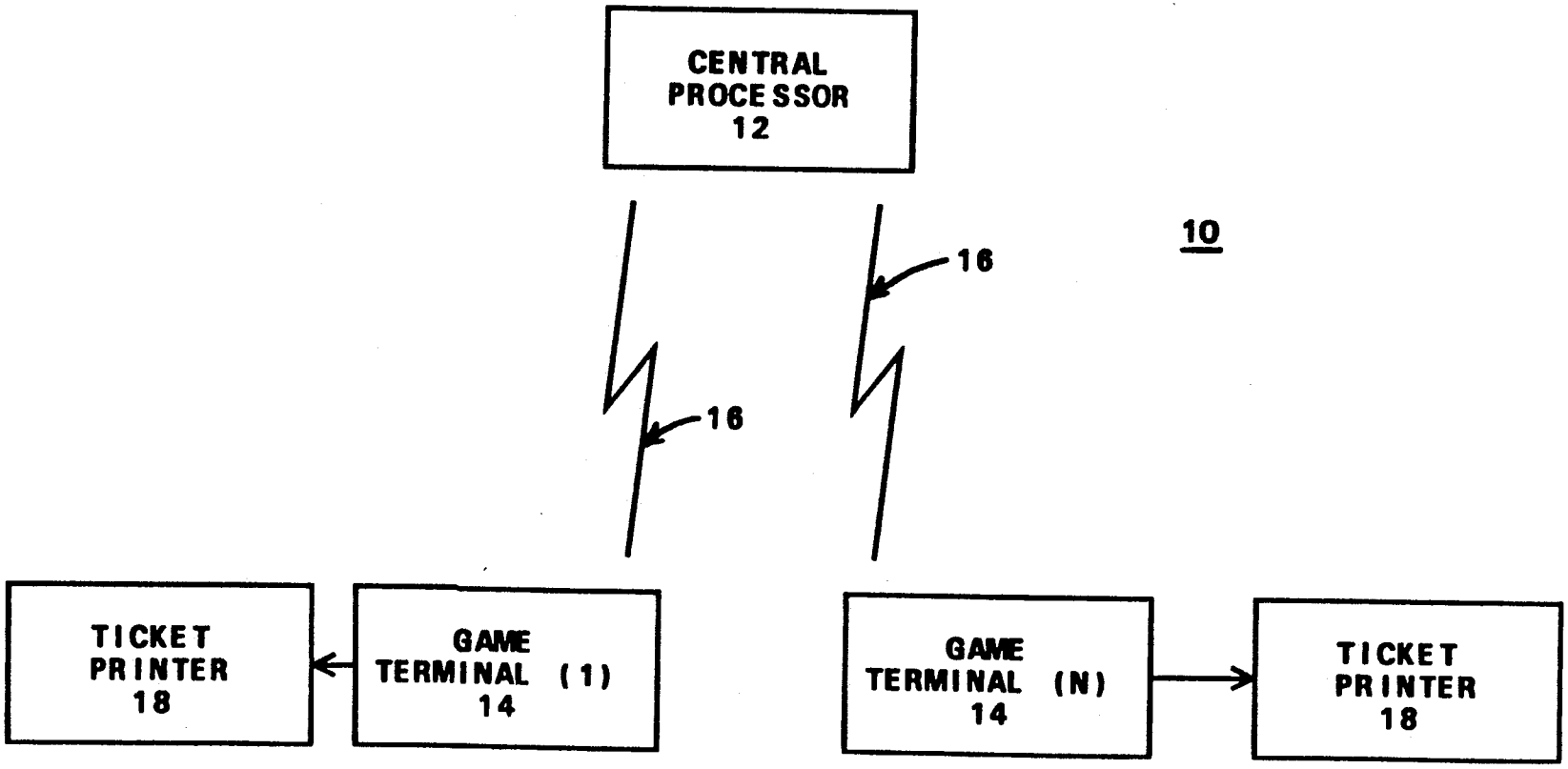
FIG. 1 is a logical block diagram representation of a gaming system according to the invention.

Referring to FIG. 1, there is shown a logical block diagram representation of a lottery gaming system generally designated by the reference character 10. The lottery gaming system 10 includes a central processor 12 and a plurality of lottery game terminals 14 coupled by a corresponding communications link 16 for enabling bidirectional communications. A ticket printer 18 is coupled to each remote lottery game terminal for printing lottery tickets in response to a player's bet.

Figure 2:
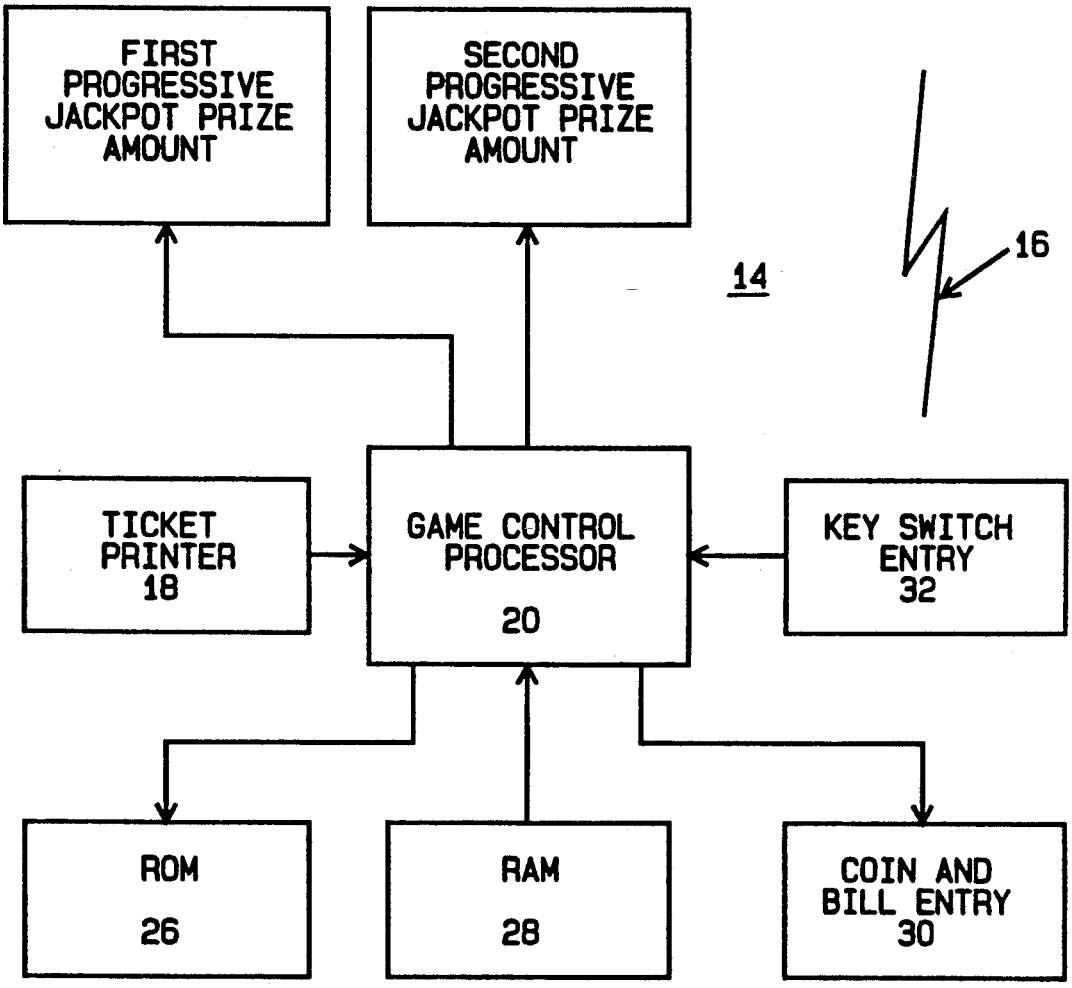
FIG. 2 is a logical block diagram representation of a lottery terminal of the gaming system of FIG. 1.

Referring to FIG. 2, each remote lottery game terminal 14 includes a game control processor 20 that operatively controls the ticket printer 18 and is coupled to associated memory devices, such as a read only memory (ROM) 26 for storing program and game functions and a random access memory (RAM) 28 for storing game parameter data. A coin and bill entry device 30 and a keyswitch entry device 32 provides player input signals to the game control processor 20. The remote lottery game terminals 14 can be operated by a lottery agent or directly by a player of the lottery game.

Figure 3:
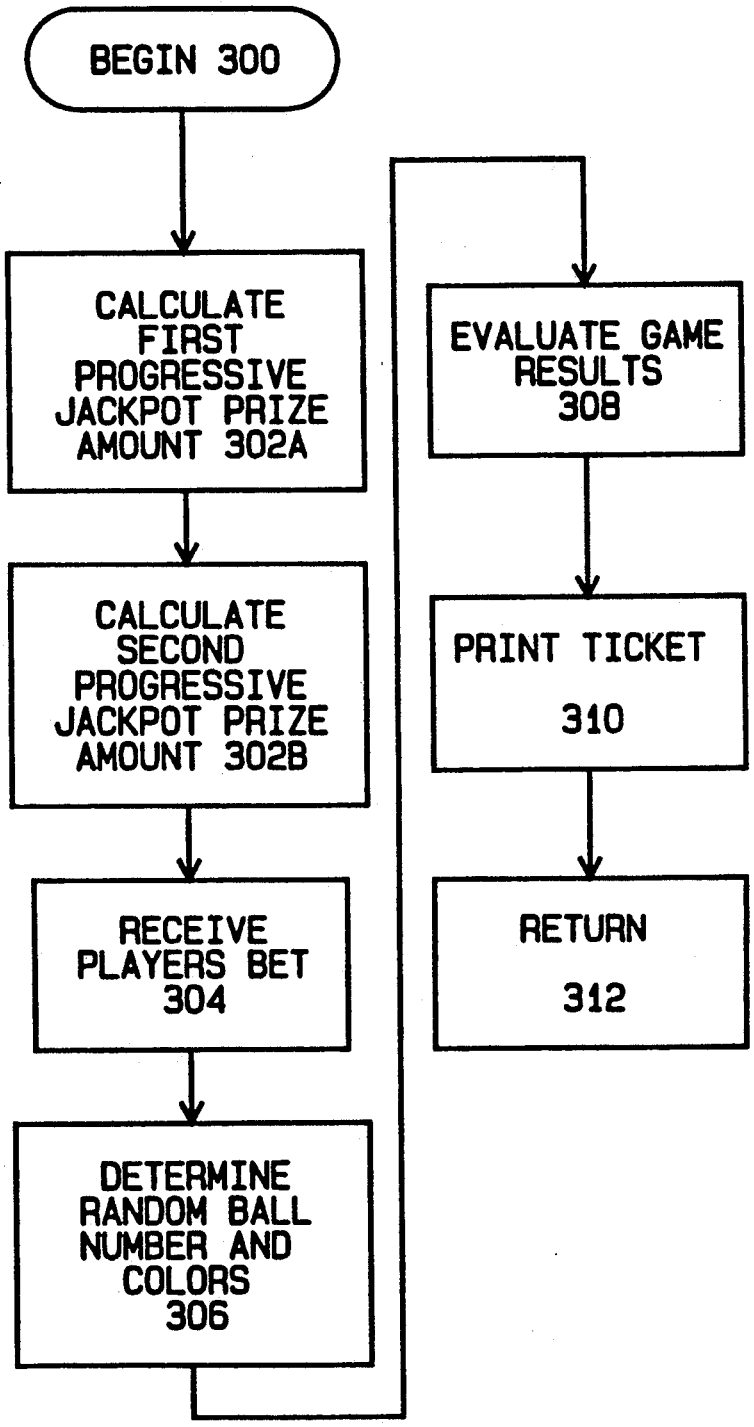
FIG. 3 is a logical flow diagram illustrating the logical functions of the gaming system of FIG. 1.

Referring to FIG. 3, there is shown logical flow diagram illustrating logical functions of the lottery game system 10. Sequential operations begin at a block 300 in FIG. 3. The central processor 12 can be used for controlling the operation of the lottery game and for maintaining pari-mutuel jackpot prize schedules for the entire network of lottery game terminals 14. Alternatively, each lottery game terminal 14 can be adapted for maintaining pari-mutuel jackpot prize schedules and for independent operation of the lottery game. Periodically the pari-mutuel jackpot prize schedules are calculated at a block 302.

In FIG. 3, a player's bet is received at a block 304, then the central processor 12 or the game control processor 20 randomly generates five random ball numbers and colors at a block 306. U.S. patent application Ser. No. 07/795,129, filed Nov. 20, 1991, discloses sequential game steps for randomly selecting numerical symbols and color of a plurality of balls, identifying game results and winning combinations, if any, and calculating pari-mutuel jackpot prize schedules that are performed for printing a lottery ticket using the ticket printer 18, rather than for being displayed in the disclosed video lottery game. The disclosure of U.S. patent application Ser. No. 07/795,129, filed Nov. 20, 1991 is incorporated herein by reference.

Each randomly selected ball includes one numerical symbol between 0 through 9 and one of multiple colors. The randomly selected numerical symbols and ball colors are evaluated to identify game results and winning combinations at a block 308. Responsive to predetermined evaluated game results, an extra or sixth ball is randomly selected and printed on the lottery ticket.

A lottery ticket is printed including the numerical symbol and color of each of the five or six randomly selected balls at a block 310. A variable wager received from a player and an identified free replay winning combination, if any, also can be printed on the lottery ticket at the block 310. The calculated pari-mutuel jackpot prize schedules can be displayed on a communications monitor associated with the lottery terminal 14 or printed on the lottery ticket. Then the sequential operations are repeated as indicated at a block 312 labelled RETURN to receive a next player's bet at block 304.

After the ticket has been printed, then any payout is a function of the particular variable wager received from a player. For example, a payout may be a multiple of the bet and a predefined pay table.

While the invention has been described with reference to details of the illustrated embodiments, these details are not intended to limit the scope of the invention as defined in the appended claims.

What is claimed and desired to be secured by Letters Patent of the United States is:

1. A lottery game comprising:

means for calculating jackpot prize schedules; said jackpot prize schedules calculating means being based upon a preselected payback allocation percentage;

means for receiving a player's bet;

means responsive to said player's bet receiving means for randomly selecting a plurality of objects;

means for evaluating game results responsive to said randomly selected plurality of objects; said game results evaluating means including means responsive to an identified first winning combination of said randomly selected objects for calculating a first payout utilizing a fixed paytable and a player's bet received by said player's bet receiving means and means responsive to an identified second winning combination of said randomly selected objects for calculating a second payout utilizing said means for calculating jackpot prize schedules; said jackpot prize schedules including a first progressive jackpot prize amount and a second progressive jackpot prize amount, said first progressive jackpot prize amount and said second progressive jackpot prize amount being separately calculated and awarded, whereby a player winning one of said first or second progressive jackpot prize amounts does not affect the amount of the other of said first or second progressive jackpot prize amounts; and means for printing said randomly selected plurality of objects and game results on a lottery ticket responsive to said randomly selecting objects means and said game results evaluating means.

2. A lottery game as recited in claim 1 wherein said printing means include means for printing a player's bet on the lottery ticket.

3. A lottery game as recited in claim 1 wherein said means for calculating jackpot prize schedules and means for randomly selecting a plurality of objects are included in a central processor used with a plurality of remote terminals.

4. A lottery game as recited in claim 3 wherein said means for receiving a player's bet and means for printing said randomly selected plurality of objects are included with each remote terminal.

5. A lottery game as recited in claim 1 wherein said means for calculating jackpot prize schedules, means for receiving a player's bet, means for randomly selecting a plurality of objects, and means for printing said randomly selected plurality of objects on a lottery ticket are included with a plurality of remote terminals.

6. A lottery game as recited in claim 1 wherein said plurality of objects include five balls, each ball randomly selected from numerical symbols 0 through 9.

7. A lottery game as recited in claim 6 wherein each of said balls further includes one of a plurality of predetermined colors.

8. A lottery game as recited in claim 7 wherein said means for evaluating game results include means for identifying matching numerical symbols of said selected objects and wherein a sixth ball is randomly selected responsive to a predetermined evaluated game result.

9. A lottery game as recited in claim 8 wherein said predetermined sixth ball game result includes five matching numerical symbols.

10. A lottery game as recited in claim 8 wherein said predetermined sixth ball game result includes at least two matching numerical symbols and not a winning combination.

11. A lottery game as recited in claim 8 wherein said sixth ball includes a numerical symbol and a color used to determine when a payout results of a first progressive jackpot prize amount or a second progressive jackpot prize amount.

12. A lottery game as recited in claim 8 wherein said means for evaluating game results include means for identifying a free replay combination of numerical symbols and wherein a free replay combination is printed on the lottery ticket.

13. A method of playing a lottery game comprising the steps of:

calculating jackpot prize schedules based upon a preselected payback allocation percentage; said jackpot prize schedules including a first progressive jackpot prize amount and a second progressive jackpot prize amount;

receiving a player's bet;

randomly selecting a plurality of objects;

evaluating game results responsive to said randomly selected objects;

identifying a first winning combination of said randomly selected objects and calculating a payout utilizing a fixed paytable and a player's bet;

identifying a second winning combination of said randomly selected objects and calculating a payout utilizing a jackpot prize schedule calculation of one of said first or second progressive jackpot prize amounts; said first progressive jackpot prize amount and said second progressive jackpot prize amount being separately calculated and awarded, whereby a player winning one of said first or second progressive jackpot prize amounts does not affect the amount of the other of said first or second progressive jackpot prize amounts; and printing said randomly selected plurality of objects and game results on a lottery ticket responsive to said evaluated game results.

* * * * *